United States Patent [19]

Tilton

[11] Patent Number: 4,817,650

[45] Date of Patent: Apr. 4, 1989

[54] SELF-CONTAINED TILTABLE BASKET FOR PLATING, WASHING OR OTHERWISE TREATING HOLLOW ARTICLES

[76] Inventor: Herbert Tilton, 1 Claridge Dr., Apt. 1027, Verona, N.J. 07044

[21] Appl. No.: 140,640

[22] Filed: Jan. 4, 1988

[51] Int. Cl.[4] ..... B08B 3/04

[52] U.S. Cl. ..... 134/76; 134/85; 134/135; 134/156; 134/157; 134/158; 118/500; 204/202; 204/300 EC

[58] Field of Search ..... 134/76, 85, 135, 156, 134/160, 73, 157, 158, 159; 68/152; 118/425, 428, 500; 204/198, 199, 202, 212, 213, 214, 300 EC

[56] References Cited

U.S. PATENT DOCUMENTS

| | | | |
|---|---|---|---|
| 2,482,269 | 9/1949 | Grimes | 204/202 X |
| 2,632,453 | 3/1953 | Friedman | 134/156 X |
| 2,706,485 | 4/1955 | Ferrari, Jr. | 134/156 X |
| 2,743,733 | 5/1956 | Sacks et al. | 134/156 X |
| 2,744,842 | 5/1956 | Golden | 134/156 X |
| 2,780,229 | 2/1957 | Davis | 134/160 X |
| 3,047,436 | 7/1962 | Zinty | 134/160 X |
| 3,141,468 | 7/1964 | Kupferschmid | 134/156 X |
| 3,472,203 | 10/1969 | Coleman | 134/160 X |
| 3,910,297 | 10/1975 | Pinkham | 134/76 X |
| 4,331,230 | 5/1982 | Buckley | 134/135 X |
| 4,746,416 | 5/1988 | Jacob | 118/428 X |

FOREIGN PATENT DOCUMENTS

| | | | |
|---|---|---|---|
| 1107479 | 5/1961 | Fed. Rep. of Germany | 134/76 |
| 45-34879 | 11/1970 | Japan | 134/156 |

*Primary Examiner*—Harvey C. Hornsby
*Assistant Examiner*—Stephen F. Gerrity
*Attorney, Agent, or Firm*—Lerner, Daivd, Littenberg, Krumholz & Mentlik

[57] ABSTRACT

A workpiece carrier for holding workpieces through a plurality of liquid immersion stations including, a framework structure defining an interior space, a self-contained tiltable basket module having article compartments defined therein disposed within the interior space of the frame, a pivot member connecting the basket to the frame at a point offset from the central depth of the basket to cause the basket to normally tilt towards its front, a buoyant tank connected to the basket on the side remote from the a pivot member to tilt the basket towards its rear when the workpiece carrier is immersed in a liquid solution, effectively dissipating any air or gas pockets which might have formed in the hollow areas of the workpiece being treated.

11 Claims, 5 Drawing Sheets

SELF-CONTAINED TILTABLE BASKET FOR PLATING, WASHING OR OTHERWISE TREATING HOLLOW ARTICLES

BACKGROUND OF THE INVENTION

This invention relates to an apparatus for holding articles during an electroplating, washing, painting or anodizing process or other similar processes in which the article must be immersed in liquid solution. More specifically, the instant invention relates to a self-contained frame and basket module which can be utilized in association with any type of overhead conveyor or travelling hoist which facilitates in immersing articles in various substances.

In any of the aforementioned processes, it is imperative that the solution in which the article is immersed coats the entire surface of the article. This is especially important in situations where the article must be immersed in a plurality of solutions prior to completion of a given process. For example, an electroplating process requires several immersion steps where inadequate coverage of any of the solutions utilized in the immersion steps might produce inferior plating quality, perhaps decreasing the rust-inhibiting or pit-preventing quality of the plated article.

The above referenced drawback is particularly apparent where the article to be treated is hollow or partially hollow since air pockets often form in corners of the hollow articles or in other hollow areas of the article when the same is submersed thereby preventing proper solution coverage in these areas.

The various industries which regularly employ such treatment processes have attempted to solve the problem by designing immersion tanks and conveyor systems which will, in effect, tilt the article or workpiece being coated to prevent such air pockets from remaining during immersion. However, these systems are expensive to manufacture and install, and further require frequent maintenance.

For instance, U.S. Pat. No. 2,780,229 to Davis discloses a work holding apparatus for treating hollow articles wherein the article must be secured by a workpiece holder having a member which is inserted in the hollow area of the article and a second member which secures the article from the exterior. This workpiece carrier is pivotally mounted to an extension member which moves laterally on a cam rail to effect the upward and downward tilting of the open end of the hollow article. Apart from the structural intricacies of this device, it is noted that the article may not be fully covered by the liquid solution because the members of a workpiece carrier are in contact with the surface of the article.

U.S. Pat. No. 3,472,203 to Coleman discloses an apparatus for tilting a workpiece holder by means of supporting cables which are operated at different speeds. Similarly, U.S. Pat. No. 3,047,436 to Zinty discloses an apparatus for cleaning tubes and the like by means of alternately lowering a horizontally supported workpiece holder.

U.S. Pat. No. 4,331,230 to Buckley discloses a work rack for conveying and tilting workpieces through a plurality of treating stations wherein the tilting motion is effected by a supporting member which abuts a stop member during vertical movement.

U.S. Pat. No. 2,706,485 to Ferrari, Jr., discloses an apparatus for washing test tubes which comprises a floatation device having a rack member thereon and being pivotally connected to the interior of a container so that when a liquid solution is introduced into said container the floatation device will cause one end of the rack to tilt upwardly.

In carefully reviewing the structure and operation of the prior art devices discussed above, it becomes increasingly apparent that an inexpensive and effective solution has not heretofore been conceived and practiced. Thus, industries such as the electroplating industry are in need of inexpensive and easily implemented means for tilting a workpiece which is immersed in a liquid solution for coating or washing so as to ensure complete coverage of the liquid on the hollow workpiece and prevent the formation of gas or air pockets therein.

The present invention is particularly directed to a self-contained tiltable frame and basket module for receiving a plurality of hollow articles to be plated, washed or otherwise treated in a liquid solution. The self-contained basket of the present invention is adapted for use with virtually any conveyor or hoist system currently used in the electroplating or related industry.

Frame and basket systems of the type contemplated by the present invention can be varied and altered for adaptation to a variety of plating or washing applications. For instance, the concepts underlying the present invention can be employed with regard to the cleaning of test tubes as well as the electroplating of large chassis. By employing the self-contained basket described herein manufacturers need not purchase new or specifically adapted conveying apparatus or liquid immersion tanks, but instead need only make the small expenditure for the self-contained basket, the design of which can be easily adapted for any application.

SUMMARY OF THE INVENTION

The inventive concepts which confer the aforementioned advantages of the present invention are embodied in an improved workpiece carrier which includes, a generally square or rectangular frame having a series of interconnected vertical and horizontal members and horizontal strut members to define an interior space of predetermined size, a generally square or rectangular basket sized to fit within the frame, said basket having a plurality of spaced interconnected rod members to define at least one compartment of predetermined size and shape to receive an article to be treated in liquid solution tanks, fulcrum means connecting the frame and basket in a medially offset position to cause the basket to normally tilt in a single direction, at least one buoyant hollow ballast tank connected to the basket on the side remote from the fulcrum means to tilt the basket in the direction opposite the normally tilted direction when the frame and basket are immersed in a liquid solution tank, and means for connecting the aforedescribed frame and basket system to an overhead conveyor or hoist system. It is the tilting action effected by the hollow ballast tank which causes the dissipation of any air or gas pockets which might be formed in the corner of the article or chassis being immersed in the liquid solution tank.

Accordingly, it is an object of the present invention to provide an improved workpiece carrier for holding articles during an electroplating, washing, painting or anodizing process whereby the structure and operation of conventional conveyor or hoist systems and liquid solution tanks need not be altered.

It is another object of the present invention to provide a workpiece carrier which is self-contained and comprises a structure which is easily adaptable to a variety of immersing processes, and to hold articles of any size, shape or weight.

It is another object of the present invention to provide a workpiece carrier which ensures complete solution coverage of a hollow article being immersed during an immersing process by causing the dissipation of any air or gas pockets which might form in the corners of the article being immersed.

It is another object of the present invention to provide a workpiece carrier for use with immersing processes which substantially eliminates "drag-out" of a particular liquid solution from one liquid solution tank to another.

These and other objects will become apparent, as will a better understanding of the concepts underlying the present invention by reference to the detailed description which follows below and is to be studied in conjunction with the drawings.

DESCRIPTION OF THE INVENTION

FIGS. 1 to 13 of the drawings show the preferred structure of the self-contained tiltable basket in accordance with the present invention whereby the frame and basket system are generally designated as 10. As this frame and basket system 10 is specifically adapted to meet and overcome problems relating to the incomplete coverage of hollow articles being immersed in liquid solution tanks, FIG. 1 is furnished to illustrate the general type of process with which the present invention could be employed.

Figure 2:
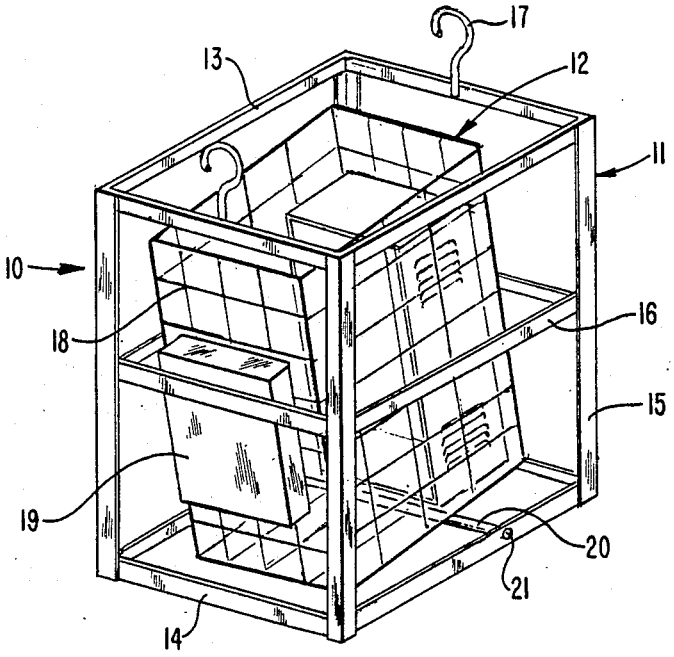
FIG. 2 is a perspective view of a self-contained basket module in accordance with the present invention.
Figure 3:
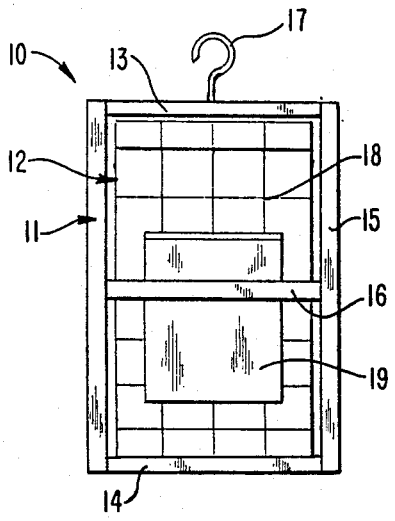
FIG. 3 is a front view of the self-contained basket module shown in FIG. 2.
Figure 4:
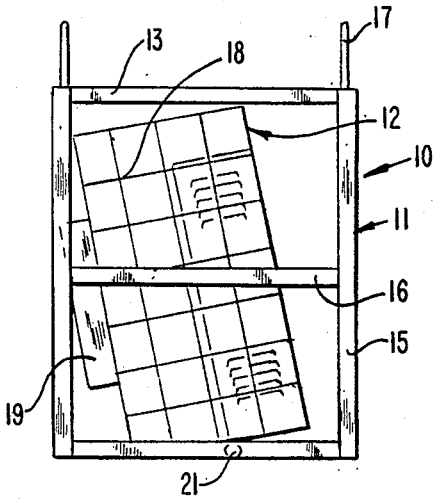
FIG. 4 is a side view of the self-contained basket module shown in FIG. 2 illustrating in particular the normally forward tilted position.

FIGS. 2–4 illustrate the preferred structure of the frame and basket system 10. For the purpose of illustrating the operation and concepts underlying the present invention, as shown in FIGS. 6–10A, the structure of this first illustrated embodiment of the present invention is adapted for receiving one hollow article.

Figure 11:
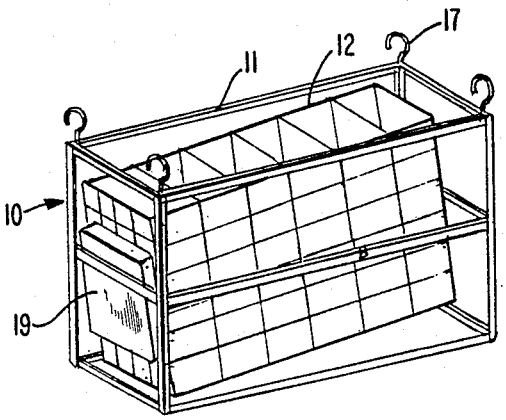
FIG. 11 is a perspective view of a self-contained frame and basket module in accordance with a second embodiment of the present invention wherein several hollow articles may be simultaneously held for treatment.
Figure 12:
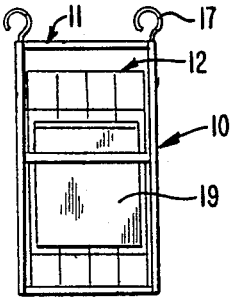
FIG. 12 is a side view of the self-contained frame and basket module shown in FIG. 11.
Figure 13:
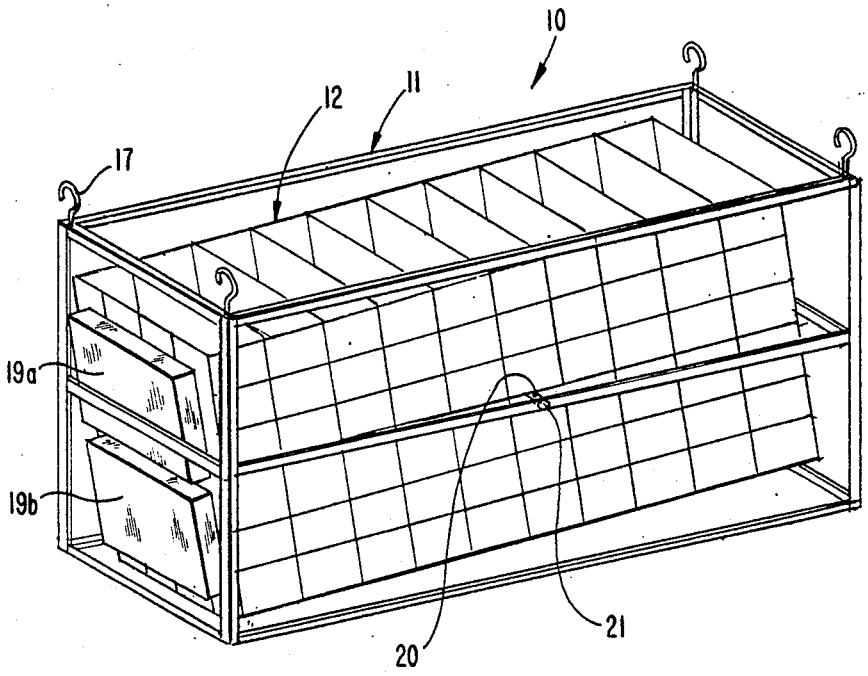
FIG. 13 is a perspective view of a self-contained frame and basket module in accordance with a third embodiment of the present invention wherein two hollow ballasts are utilized to compensate for articles of greater weight.

FIGS. 11–13 show embodiments of the present invention which are adapted to hold more than one hollow article but are of a substantially similar structure as the first illustrated embodiment.

Figure 1:
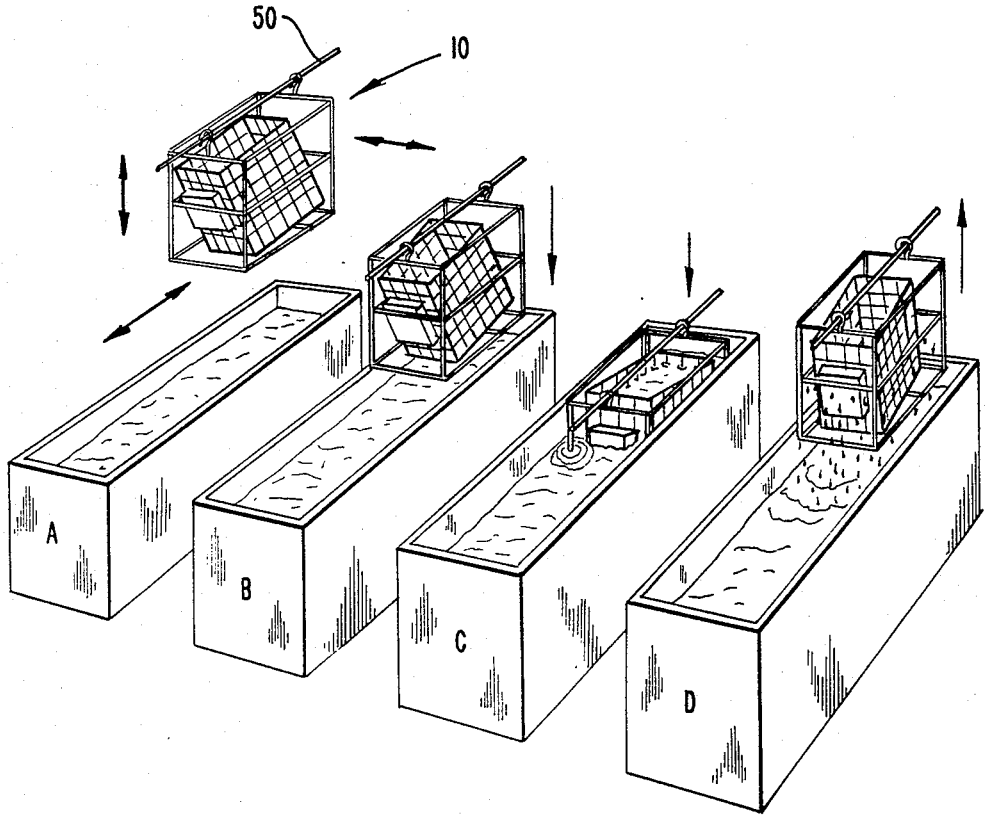
FIG. 1 is a perspective view of a series of liquid solution tanks and self-contained basket modules in accordance with the present invention illustrating the type of coating process with which the present invention could be employed.

Thus, FIG. 1 shows a frame and basket module 10 removably connected to a descendible member 50 of any conveyor or hoist system. The structure of a particular conveyor hoist system was intentionally omitted from FIG. 1 since the present invention is adaptable for use with virtually any conveyor or hoist systems. Liquid solution tanks A, B, C and D each might contain a different liquid solution and are in line with one another as most electroplating processes include the steps of successive immersion in various liquid solutions.

Accordingly, FIG. 1 shows the frame and basket system 10 in its uppermost position over tank A. This is the position the frame and basket module 10 would be in prior to or following immersion in tank A. The frame and basket module 10 is then shown descending into tank B where it would be treated with the liquid solution contained in tank B. The frame and basket module 10 is then shown partially immersed in tank C where it is treated with the liquid solution contained in tank C. Finally, the frame and basket module 10 is shown as it is withdrawn from tank D after treatment in the solution contained in tank D.

Referring specifically to FIGS. 2–4, the frame and basket system 10 includes a frame 11 and a basket 12, each of which have a generally rectangular shape. One skilled in the art will readily recognize that all elements of the frame and basket system 10 must be constructed of a material which will not corrode or otherwise interfere with the treatment of the hollow article contained therein. For instance, in an electroplating process, the frame and basket might be made from an aluminum alloy.

Frame 11 consists of four horizontal members 13 defining a square top, four horizontal members 14 defining a square bottom, and four vertical members 15 which connect said top and bottom portions of frame 11 to define and a front, rear, right side and left side of frame 11, and an interior space for the basket 12. Horizontal strut members 16 are fixed between the respective vertical members 15 in the medial portion of frame 11 to strengthen the framework structure. Frame 11 further includes hooks 17 or any other means for removably connecting the frame and basket system 10 to a conveyor or hoist system.

A plurality of vertical and horizontal rod members 18 are spaced and interconnected to define the basket 12 and the article compartment therein. Thus, the vertical and horizontal rod members define the top, bottom, front, rear, left side and right side of the basket 12, and an article compartment to hold a hollow article. It is noted, however, that in this embodiment of the present invention the top of basket 12 is left substantially open so that the hollow article to be dipped in liquid solution can be inserted and removed from the article compartment of basket 12.

Basket 12 further includes hollow ballast tank 19 which can be permanently fixed or removably fixed to the front of basket 12. Hollow ballast tank 19 is leak proof and therefore buoyant. Its purposes, if not already apparent, will be discussed in detail below.

The basket 12 is fixed to frame 11 at a fulcrum point defined by pivot rod 20 which, in this embodiment, is represented by a horizontal member which is extended beyond the width of the basket 12 for pivotal connection to frame 11 as at 21. FIG. 4 shows that this pivot connection is made at a point offset from the front of basket 12 and frame 11, resulting in the normally tilted position of basket 12 as shown therein. Of course, the weight of ballast tank 19 aids in normally tilting forward basket 12.

As shown in FIGS. 2–4, no portion of basket 12 extends beyond the boundary of frame 11, and therefore frame 11 can be sized to fit a particular liquid solution tank without concern as to the size of basket 12.

Figure 5:
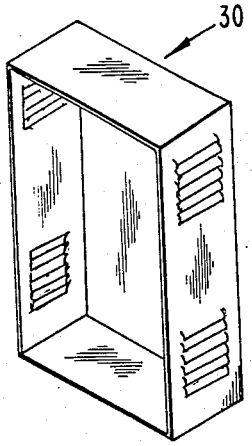
FIG. 5 is a perspective view of a hollow article of the type contemplated for use with the self-contained basket module of the present invention.

FIG. 5 shows the type of article which might be held within the frame and basket module 10. Generally designated as 30, this article has many corners and hollow spaces, which tend to trap air or gases during a conventional immersing process. The formation of such air or gas pockets inhibits liquid coverage of these areas, possibly destroying the desired quality or characteristics a coating process is meant to provide. Other corners and hollow portions such as those located at the lower portion of article 30 will hold an excess amount of the liquid solution after immersion is completed, whereby this excess would be transported to a subsequent liquid solution tank. This is commonly referred to as "drag-out", and can also destroy the desired results of an immersion process.

Figure 6:
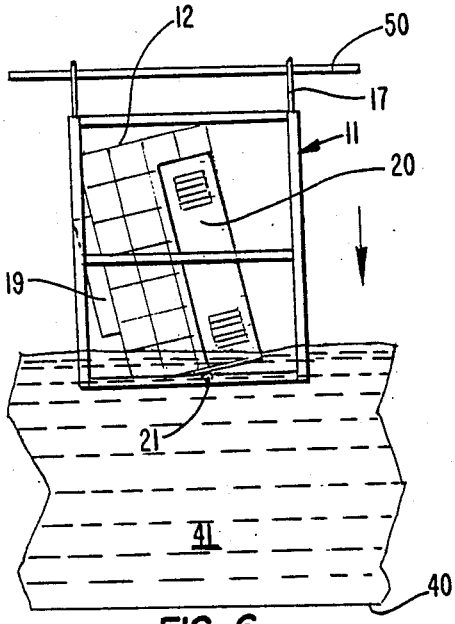
FIG. 6 is a side view of the self-contained basket module of the present invention with a hollow article therein as the same is entering a liquid solution for coating.

FIG. 6 shows a side view of the frame and basket system 10 holding hollow article 30 and commencing immersion into liquid solution 41 contained in liquid solution tank 40 (shown in cross-section). Thus, frame and basket module 10 is shown partially immersed in liquid solution 41 whereby the hollow ballast 19 has just made contact with the liquid solution 41.

It should be noted that the hollow article 30 is held in the frame and basket system 10 so that its hollow or open portion is disposed towards the front of the frame and basket system, that is, towards the ballast 19.

Figure 7:
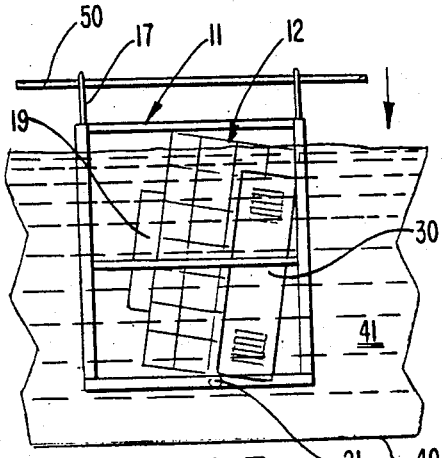
FIG. 7 is a side view of the self-contained frame and basket module and hollow article shown in FIG. 6 as it is immersed further into the liquid solution, illustrating in particular the tilting action effected by the hollow ballast.
Figure 7A:
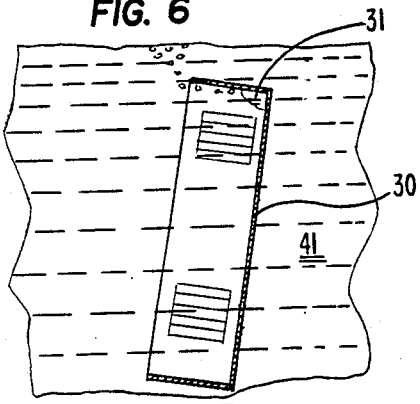
FIG. 7A is a cross-sectional view of the hollow article shown in FIG. 7 illustrating in particular the dissipation of the air pocket trapped in the corner thereof.

As the frame and basket module 10 is further immersed in liquid solution 41, the hollow ballast tank 19, by virtue of its buoyancy, causes basket 12 to tilt toward the rear of frame 11, pivoting on pivot rod 20 at the fulcrum point. FIG. 7A is a cross-section of article 30 as it would appear in FIG. 7, showing in particular the dissipation of air or gas pockets 31 as effected by the titling action of basket 12.

Figure 8:
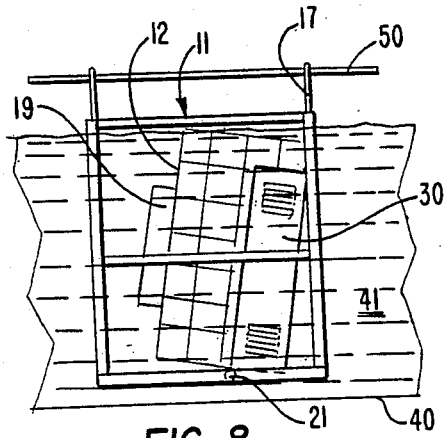
FIG. 8 is a side view of the self-contained frame and basket module and hollow article shown in FIGS. 6 and 7 as the same is fully immersed in the liquid solution.
Figure 8A:
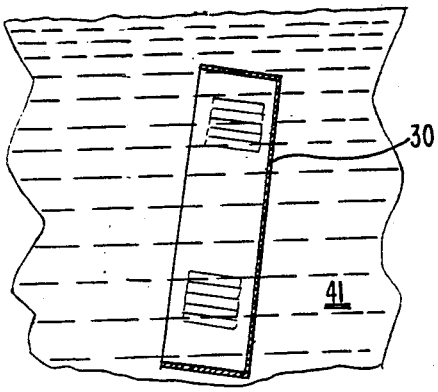
FIG. 8A is a cross-sectional side view of the hollow article shown in FIG. 8 illustrating the full coverage of the interior of the article after substantial dissipation of the air pocket.

FIG. 8 shows the frame and basket module 10 fully submersed in the liquid solution 41 whereby the basket 12 has been fully tilted towards the rear of frame 11 by hollow ballast tank 19. FIG. 8A shows a cross-section of article 30 as it would appear in FIG. 8, illustrating the absence of air or gas pockets. Thus, the liquid solution 41 has fully and completely contacted every portion of article 30.

Figure 9:
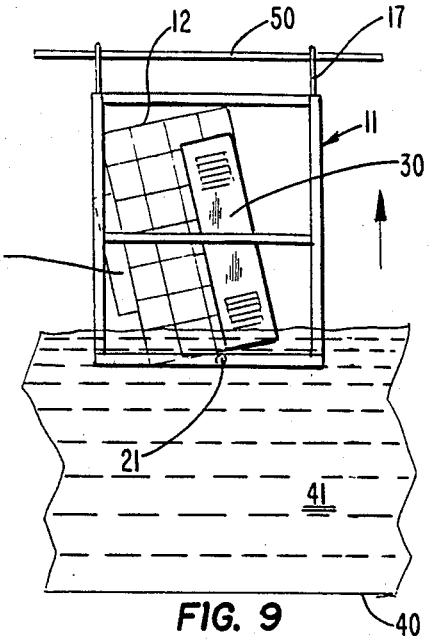
FIG. 9 is a side view of the self-contained frame and basket module and hollow article shown in the preceding FIGURES as it is being drawn from the liquid solution tank.

As the article 30 has now been completely covered with liquid solution 41, the frame and basket module 10 can be withdrawn from liquid tank 40 as shown in FIG. 9. As can be seen, the offset pivot point defined by pivot rod 20 causes basket 12 to tilt toward the front of frame 11 once the hollow ballast tank 19 is substantially out of liquid solution 41 where its buoyancy no longer effects the position of basket 12. The weight of hollow ballast tank 19, at least in this embodiment, aids in returning basket 12 to its normally tilted position.

Figure 10:
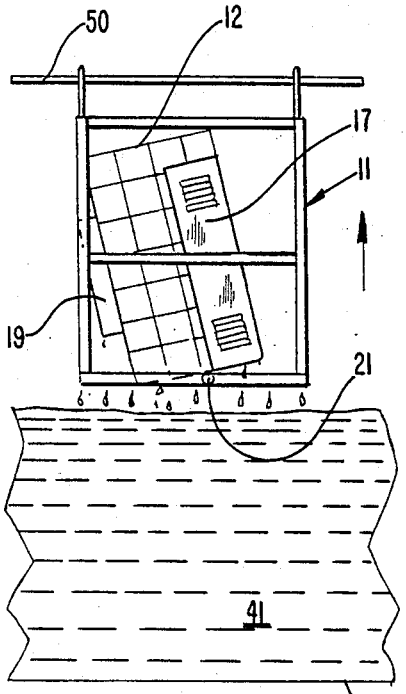
FIG. 10 is a side view of the self-contained frame and basket module and hollow article shown in the preceding FIGURES where the same has been fully drawn from the liquid solution.
Figure 10A:
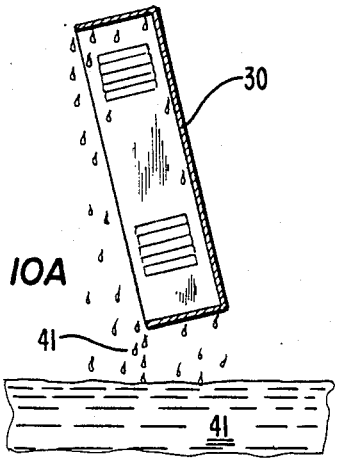
FIG. 10A is a cross-sectional view of the hollow article shown in FIG. 10 illustrating the draining of excess liquid from the same to prevent "drag-out" into other liquid solution tanks.

FIGS. 10 and 10A illustrate the draining aspect of the present invention which prevents "drag-out". Thus, FIG. 10 shows the frame and basket module 10 with article 30 therein after it has been fully withdrawn from liquid solution tank 40, and FIG. 10A shows a cross-section of article 30 as it would appear in FIG. 10 illustrating in particular the draining of liquid solution 41 from article 30. Once this draining is substantially complete, the frame and basket module 10 with article 30 therein can be indexed to the next liquid solution tank with little reservation as to the potentially harmful "drag-out" of liquid solution 41.

As indicated earlier, the single article holding embodiment illustrated in FIGS. 6–10A was only utilized to demonstrate the concepts underlying the structure and operation of the present invention. It will be recognized that such a single article holding embodiment might not be feasible from the standpoint of cost effectiveness, and therefore the embodiment shown in FIGS. 11 and 12 and the embodiment shown in FIG. 13 are furnished to illustrate the structural flexibility underlying the conceptual spirit of the present invention. As the elements of these embodiments are identical to those in the first illustrated embodiment, identical numerical references will be utilized.

Thus, FIGS. 11 and 12 show an embodiment in which twelve article compartments are defined by the vertical and horizontal rod members 18 of basket 12, six such compartments being located on the lower tier and six being located on the upper tier. It will also be recognized that the fulcrum point is provided in the medial section of basket 12 rather than at its lower end as was the fulcrum point of the first illustrated embodiment. Thus, the horizontal strut member 16 of frame 11 provides the pivotal connection point as at 21 rather than the horizontal members 14 which form the bottom of frame 11. Those skilled in the art will recognize that such a change in the position of the fulcrum point defined by pivot rod 20 must be considered once the size requirements of a particular frame and basket module 10 are determined.

FIG. 13 shows a frame and basket system 10 which can hold twenty hollow articles, and is particularly adapted for use with heavy articles as it provides two hollow ballast tanks 19*a* and 19*b*. One skilled in the art will readily recognize that when particularly heavy articles or a greater number of articles are inserted in the basket 12, greater buoyancy forces will be required to effect the rearwardly tilting of the basket 12 during immersion. It is for this reason that two ballasts 19*a* and 19*b* are provided in this embodiment.

Consistent with the objects of the present invention relating to versatility, the hollow ballast tank 19 or tanks 19*a* and 19*b* can be designed to be removably mounted on horizontal rod members 18 of basket 12. In this manner, the ballasts can be mounted on the front of basket 12 in the optimum position for the size and weight of the hollow articles to be treated.

Thus, a particularly versatile self-contained frame and basket module for holding hollow articles during an electroplating, washing, painting or anodizing process or other similar processes in which a hollow article must be immersed in liquid solution has been described.

It is to be understood that the present invention is not to be limited to the specific structure or embodiment shown and described herein but that it is entirely consistent with the spirit of the present invention to modify the same within the scope of the invention as defined by the claims which follow immediately below.

What is claimed is:

1. A self-contained frame and basket system for holding hollow articles during immersion in a liquid solution within a tank comprising, a. said frame having a series of openly spaced interconnected vertical and horizontal members to define an interior space, said frame being carried by a conveyor system for immersion in said liquid solution such that when immersed said liquid solution passes between said openly spaced members to fill said interior space;

b. said basket disposed within said frame and having a plurality of spaced interconnected rod members defining at least one article compartment therein;

c. pivot means connecting said basket to said frame at a point offset from the center of said basket to cause said basket to normally tilt in a single direction;

d. at least one buoyant tank connected to the rod members of basket on the side of said basket remote from the pivot means to tilt the basket in a direction opposite the normally tilted direction when the frame and basket are immersed in said liquid solution to effectively dissipate any air pockets which might form in the hollow article.

2. A self-contained frame and basket system for holding hollow articles during immersion in a liquid solution within a tank comprising, a. said frame having a series of openly spaced interconnected members defining an interior space, said frame being carried by a conveyor system for immersion in said liquid solution such that when immersed said liquid solution passes between said openly spaced members to fill said interior space;

b. said basket having a front and rear and defining at least one article compartment for receiving an article, said basket sized to fit within the interior space of said frame;

c. pivot means connecting said basket within said frame at a point offset towards the rear of said basket to cause said basket to normally tilt towards the front of said basket;

d. buoyant means connected to the front of said basket to cause said basket to tilt towards the rear thereof when the frame and basket system is immersed in solution.

3. The frame and basket system as claimed in claims 1 or 2 wherein the pivot means is located at the bottom of said basket and said frame.

4. The frame and basket system as claimed in claims 1 or 2 wherein the pivot means is located in the medial portion of the frame and basket system.

5. The frame and basket system as claimed in claims 1 or 2 wherein two ballasts are removably connected to the front of said basket.

6. The frame and basket system as claimed in claims 1 or 2 wherein said basket includes six article compartments on a lower tier and six article compartments on an upper tier.

7. A self-contained frame and basket system for holding hollow articles during electroplating, washing or other liquid immersion processes within a tank comprising, a. said frame having openly spaced vertical and horizontal members to define an interior space of predetermined size, said frame being carried by a conveyor system for immersion in said liquid solution such that when immersed said liquid solution passes between said openly spaced members to fill said interior space;

b. said basket having a plurality of interconnected rod members defining at least one article compartment for holding at least one article during a liquid immersion process;

c. said basket sized to fit within said interior space of said frame;

d. said basket having a pivot rod connecting said basket within said frame at a point offset from the center of said basket to cause said basket to normally tilt towards the front thereof;

e. at least one buoyant ballast tank connected to the front of said basket to cause said basket to tilt towards the rear thereof when the frame and basket are immersed in a liquid solution, effectively dissipating any air pockets which might be formed in the corner of a hollow article carried by the frame and basket system.

8. The frame and basket system as claimed in claim 7 wherein the pivot rod connects the basket to the frame in the medial portion thereof.

9. A frame and basket system as claimed in claim 7 wherein said at least one buoyant ballast tank is removably connected to the front of said basket.

10. The frame and basket system as claimed in claims 1, 2 or 3 wherein said basket provides an access space for said article to be inserted and removed from said article compartment.

11. The frame and basket system as claimed in claim 1, 2 or 3 wherein the outside surfaces of said basket are in close proximity to the inside surfaces of said frame.

* * * * *